US011040558B2

(12) United States Patent
Horie

(10) Patent No.: US 11,040,558 B2
(45) Date of Patent: Jun. 22, 2021

(54) MEDIUM SUPPLY DEVICE

(71) Applicant: SEIKO EPSON CORPORATION, Tokyo (JP)

(72) Inventor: Seijun Horie, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 61 days.

(21) Appl. No.: 16/260,795

(22) Filed: Jan. 29, 2019

(65) Prior Publication Data

US 2019/0232690 A1 Aug. 1, 2019

(30) Foreign Application Priority Data

Feb. 1, 2018 (JP) ..... JP2018-016536

(51) Int. Cl.

| | |
|---|---|
| ***B41J 15/04*** | (2006.01) |
| ***B65H 19/12*** | (2006.01) |
| ***B65H 16/02*** | (2006.01) |
| ***B65H 23/04*** | (2006.01) |

(52) U.S. Cl.

CPC ..... *B41J 15/04* (2013.01); *B65H 16/02* (2013.01); *B65H 19/126* (2013.01); *B65H 23/048* (2013.01); *B65H 2301/52202* (2013.01); *B65H 2403/41* (2013.01); *B65H 2404/143* (2013.01); *B65H 2408/212* (2013.01); *B65H 2801/15* (2013.01)

(58) Field of Classification Search

CPC ..... B41J 15/04; B65H 16/02; B65H 19/126; B65H 23/048; B65H 2301/52202; B65H 2403/41; B65H 2404/143; B65H 2408/212; B65H 2408/2171; B65H 2801/15

See application file for complete search history.

(56) References Cited

U.S. PATENT DOCUMENTS 3,545,694 A * 12/1970 Ehrat ..... B65H 18/10 242/413.8
4,360,137 A * 11/1982 Noe ..... B21C 49/00 226/118.2
5,190,234 A * 3/1993 Ezekiel ..... B65H 19/14 156/157

(Continued)

FOREIGN PATENT DOCUMENTS

JP 2002-068537 A 3/2002
JP 2007-320669 A 12/2007

(Continued)

*Primary Examiner* — Michael E Gallion
(74) *Attorney, Agent, or Firm* — Workman Nydegger

(57) ABSTRACT

Provided is a medium supply device including a spindle that supports a medium having a roll shape, a supplying portion that supplies the medium supported by the spindle toward outside, a plurality of support rollers that support the medium in positions between the spindle and the supplying portion, a moving roller that, in a contact position between the support rollers, is capable of coming into contact with a bridging medium extending across the support rollers in a state where a load is applied to the bridging medium and that is capable of moving from the contact position to a non-contact position of non-contact with the bridging medium, and a moving mechanism configured to move the moving roller from the contact position to the non-contact position.

6 Claims, 11 Drawing Sheets

(56) References Cited

U.S. PATENT DOCUMENTS

| | | | | |
|---|---|---|---|---|
| 7,337,936 | B2 * | 3/2008 | Ishida | B41J 15/005 226/143 |
| 10,029,876 | B2 * | 7/2018 | Hou | B65H 23/08 |
| 2001/0013561 | A1 * | 8/2001 | Wild | B65H 23/042 242/418.1 |
| 2011/0049210 | A1 * | 3/2011 | Kameda | B65H 20/24 226/46 |
| 2012/0091250 | A1 * | 4/2012 | Tenpaku | B65H 19/126 242/596 |
| 2013/0119182 | A1 * | 5/2013 | Higeta | B65H 18/145 242/538.1 |
| 2014/0267484 | A1 * | 9/2014 | LeFevre | B41J 3/543 347/16 |
| 2016/0288543 | A1 * | 10/2016 | Yoshida | B65H 23/038 |
| 2017/0096017 | A1 * | 4/2017 | Fernando | B41J 11/0015 |
| 2017/0313540 | A1 * | 11/2017 | Allen | B65H 45/142 |

FOREIGN PATENT DOCUMENTS

| | | | |
|---|---|---|---|
| JP | 2012-086908 | A | 5/2012 |
| JP | 2012-096876 | A | 5/2012 |
| JP | 2014-213473 | A | 11/2014 |

* cited by examiner

MEDIUM SUPPLY DEVICE

BACKGROUND

1. Technical Field

The present invention relates to a medium supply device.

2. Related Art

Medium supply devices of various configurations have been used. Among these, there exists a medium supply device configured to supply a medium of a roll-type to a desired external device upon insertion of the medium into an interior of the device.

For example, in JP-A-2007-320669, there is disclosed a recording medium supply device capable of supplying a recording medium of a roll type (reducing roll) to an image formation device serving as the external device.

In the medium supply device, various types of roll-type media can be used. When a large roll-type medium is used, a winding length on a support roller (transport roller) of the medium provided to the medium supply device may be lengthened to improve a transportability of the medium. For example, in the recording medium supply device in JP-A-2007-320669, a weight member is placed on the medium (recording medium) between support rollers (recording medium feeding rollers or the like) to lengthen the winding length of the medium on the support rollers, and a transport path of the medium is curved at the positions of the support rollers and the weight member, increasing a contact surface area between the transported medium and the support rollers.

Nevertheless, in the medium supply device in the related art that allows use of a roll-type medium, the medium may need to be inserted while curved and fed or the like. Thus, when a medium of a roll-type having a large size is used in particular, an operability at the time of insertion of the medium deteriorates, requiring excessive time and labor for medium insertion.

SUMMARY

Here, an object of the invention is to improve an operability when a medium of a roll type is inserted into a medium supply device.

A medium supply device according to a first aspect of the invention for solving the above-described problems includes a spindle configured to support a medium having a roll shape, a supplying portion configured to supply the medium supported by the spindle toward outside, a plurality of support rollers configured to support the medium in positions between the spindle and the supplying portion, a moving roller that, in a contact position between the plurality of support rollers, is capable of coming into contact with a bridging medium, which is the medium extending across the plurality of support rollers, in a state where a load is applied to the bridging medium, the moving roller being capable of moving from the contact position to a non-contact position of non-contact with the bridging medium, and a moving mechanism configured to move the moving roller from the contact position to the non-contact position.

According to this aspect, the medium supply device includes the moving roller that, in the contact position between the support rollers, is capable of coming into contact with the bridging medium between the support rollers in a state where a load is applied to the bridging medium, and capable of moving from the contact position to the non-contact position of non-contact with the bridging medium, and a moving mechanism of the moving roller. Thus, a contact surface area between the transported medium and the support rollers can be increased (the winding length of the medium on the support rollers can be lengthened) by positioning the moving roller into the contact position by the moving mechanism, making it possible to improve the transportability of the medium. Then, the moving roller is temporarily positioned in the non-contact position by the moving mechanism, allowing the medium to be directly fed and inserted and making it possible to improve the operability when the medium is inserted.

According to a second aspect of the invention, in the medium supply device of the first aspect, the contact position is a position where the moving roller is moved from the non-contact position to a position where a shaft core of the moving roller reaches or passes a shaft core plane connecting respective shaft cores of the plurality of support rollers.

According to this aspect, the contact position is a position where the moving roller is moved from the non-contact position to a position where the shaft core of the moving roller reaches or passes the shaft core plane connecting the respective shaft cores of the plurality of support rollers. As a result, the contact surface area between the medium and the support rollers can be effectively increased, and the transportability of the medium can be effectively improved.

According to a third aspect of the invention, in the medium supply device in the first or second aspect, at least one of the plurality of support rollers is a transport roller configured to apply to the medium a transport force for transporting the medium.

According to this aspect, at least one of the support rollers serves as the transport roller configured to apply to the medium the transport force for transporting the medium, making it possible to effectively supply the medium from the supplying portion. Thus, even when, for example, a roll-type medium having a large size is used and the transport mechanism of an external device configured to supply the medium from the medium supply device has a weak medium transport force, it is possible to effectively supply the medium to the external device.

According to a fourth aspect of the invention, the medium supply device in the third aspect further includes a press roller configured to press the medium against the transport roller.

According to this aspect, the medium supply device further includes the press roller that presses the medium against the transport roller, making it possible to more effectively transport the medium by the roller pair of the transport roller and the press roller, and particularly effectively supply the medium to the external device.

According to a fifth aspect of the invention, the medium supply device in any one of the first to fourth aspects further includes a motor configured to rotate the spindle.

According to this aspect, the medium supply device further includes the motor that rotates the spindle, making it possible to effectively supply the medium from the supplying portion to the external device. Thus, even when, for example, a roll-type medium having a large size is used and the transport mechanism of an external device configured to supply the medium from the medium supply device has a weak medium transport force, it is possible to effectively supply the medium.

According to a sixth aspect of the invention, the medium supply device in any one of the first to fifth aspects further includes a fixing mechanism configured to fix the moving roller in at least one of the contact position and the non-contact position.

According to this aspect, the medium supply device further includes the fixing member that fixes the moving roller in at least one of the contact position and the non-contact position, making it possible to suppress unintended movement by the moving roller positioned in the contact position or the non-contact position.

According to a seventh aspect of the invention, in the medium supply device according to any one of the first to sixth aspects, the moving mechanism includes a rack portion connected to the moving roller, and a pinion portion provided with a handle.

According to this aspect, the moving mechanism includes the rack portion connected to the moving roller, and the pinion portion provided with the handle, making it possible to easily move the moving roller between the contact position and the non-contact position using a simple configuration.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a medium supply device 1 according to an example of the invention will be described in detail with reference to the appended drawings.

Example 1 (FIGS. 1 to 10)

First, the medium supply device 1 according to Example 1 of the invention will be described with reference to FIGS. 1 to 10.

Figure 1:
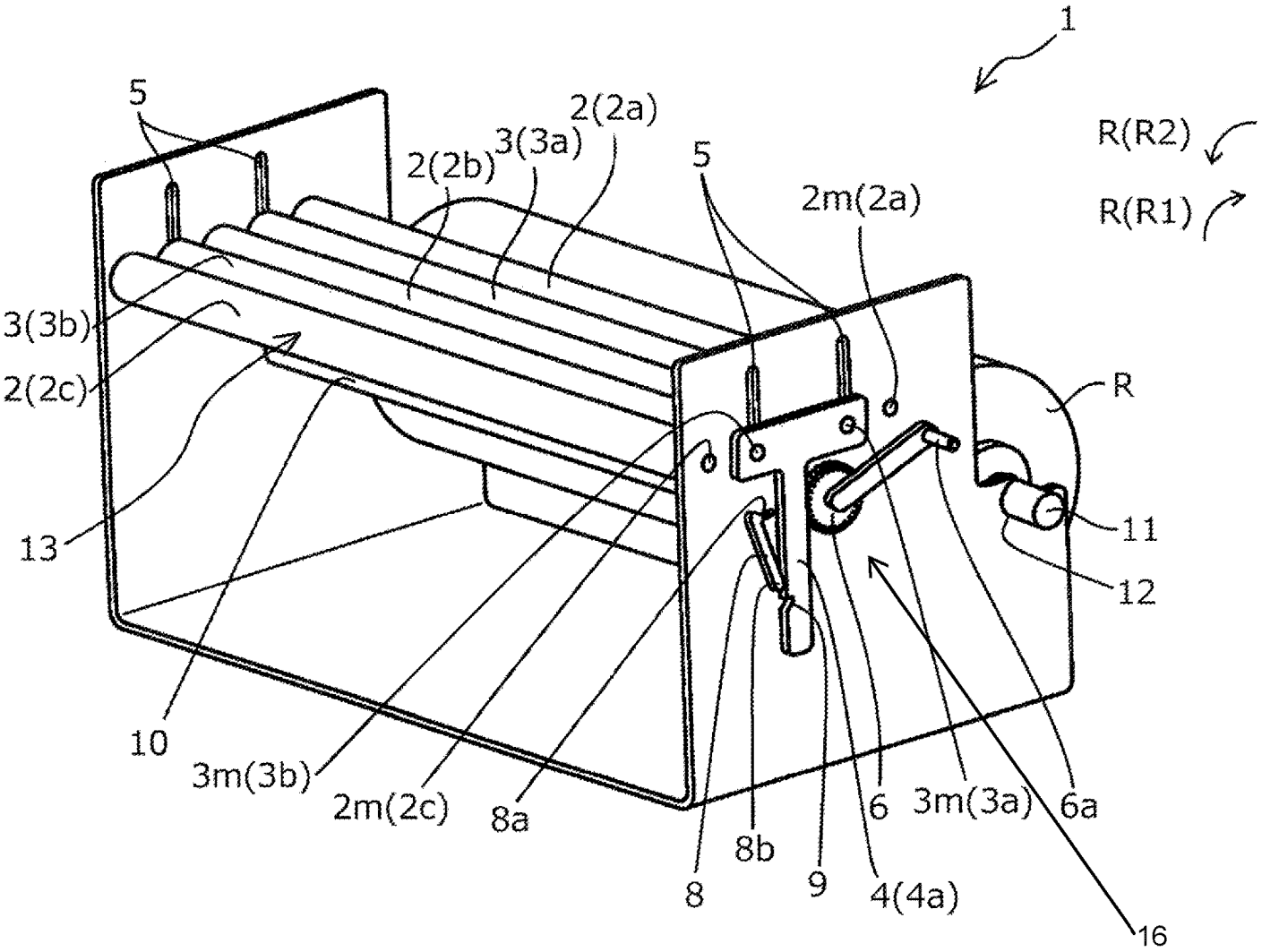
FIG. 1 is a schematic perspective view of a medium supply device according to Example 1 of the invention.
Figure 2:
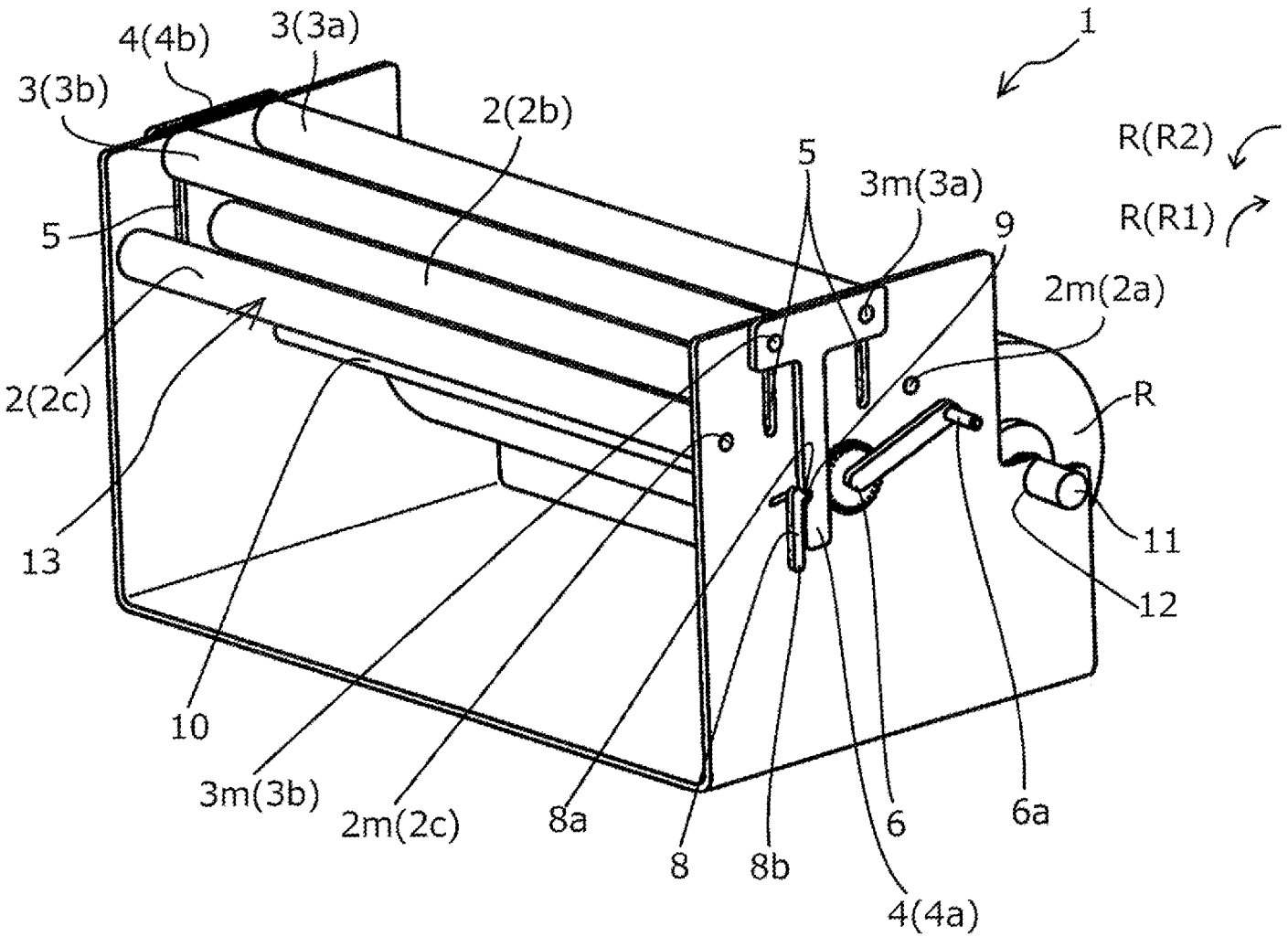
FIG. 2 is a schematic perspective view of the medium supply device according to Example 1 of the invention.
Figure 3:
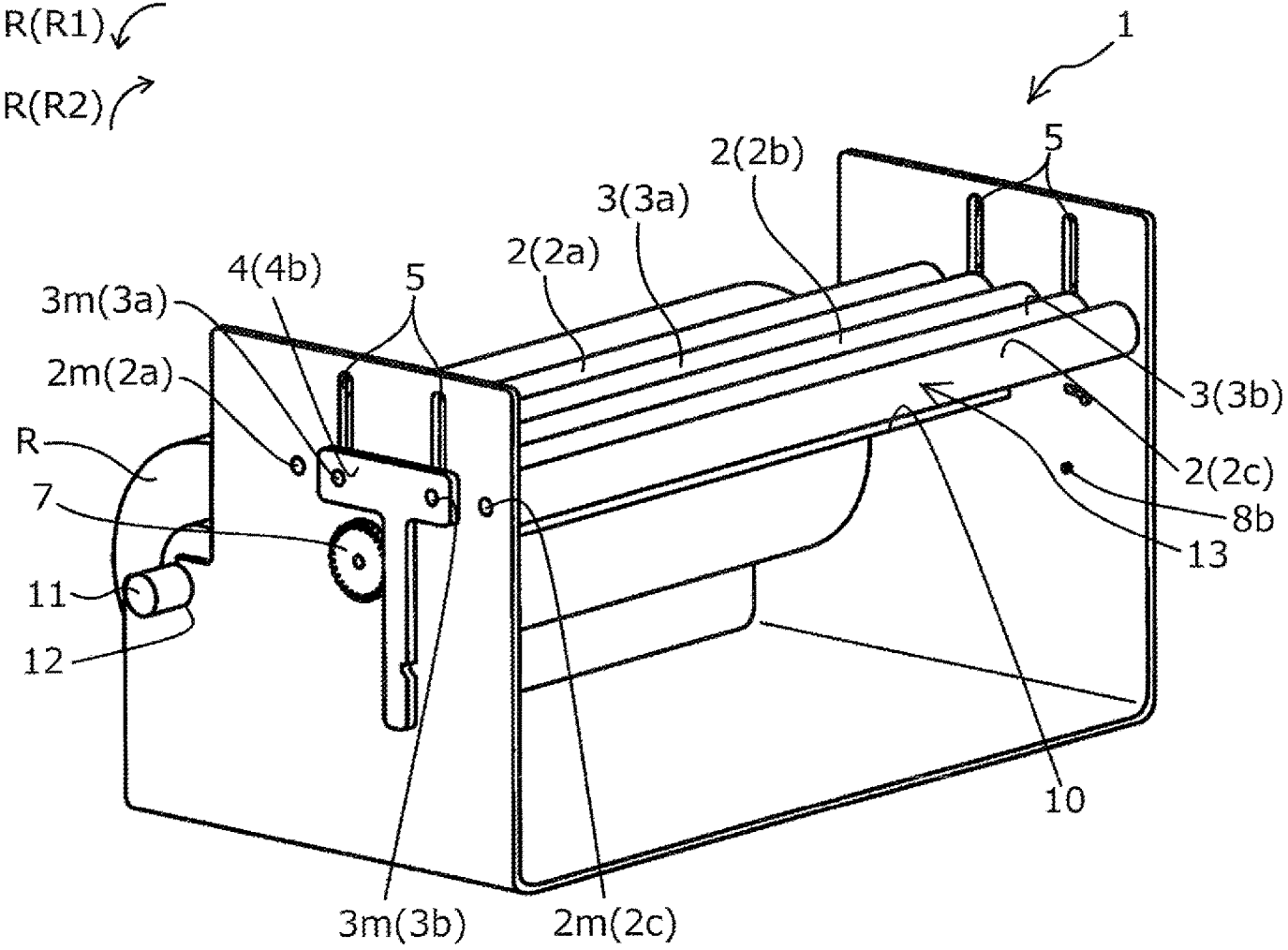
FIG. 3 is a schematic perspective view of the medium supply device according to Example 1 of the invention.
Figure 4:
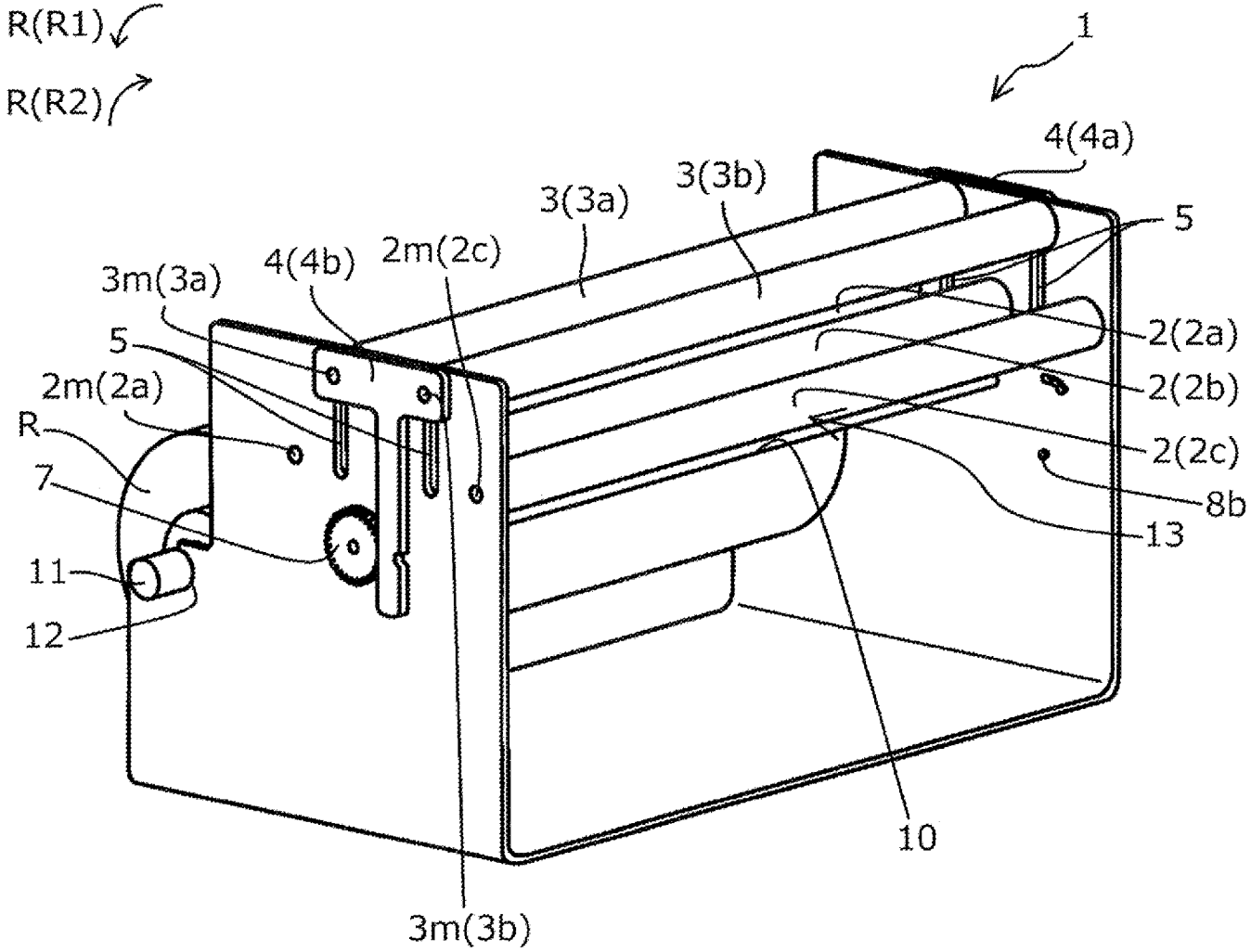
FIG. 4 is a schematic perspective view of the medium supply device according to Example 1 of the invention.

Here, FIGS. 1 to 4 are schematic perspective views of the medium supply device 1 according to this example. Of these, FIG. 1 is a perspective view from the side of a pinion portion 6 including a handle 6*a* of a moving mechanism 16 of moving rollers 3, and illustrates the moving rollers 3 in a lowered state. Further, FIG. 2 is a perspective view from the side of the pinion portion 6 including the handle 6*a* of the moving mechanism 16 of the moving rollers 3, and illustrates the moving rollers 3 in a raised state. Further, FIG. 3 is a perspective view from the side of a pinion portion 7 of the moving mechanism 16 of the moving rollers 3, and illustrates the moving rollers 3 in a lowered state. Then, FIG. 4 is a perspective view from the side of the pinion portion 7 of the moving mechanism 16 of the moving rollers 3, and illustrates the moving rollers 3 in a raised state.

Figure 5:
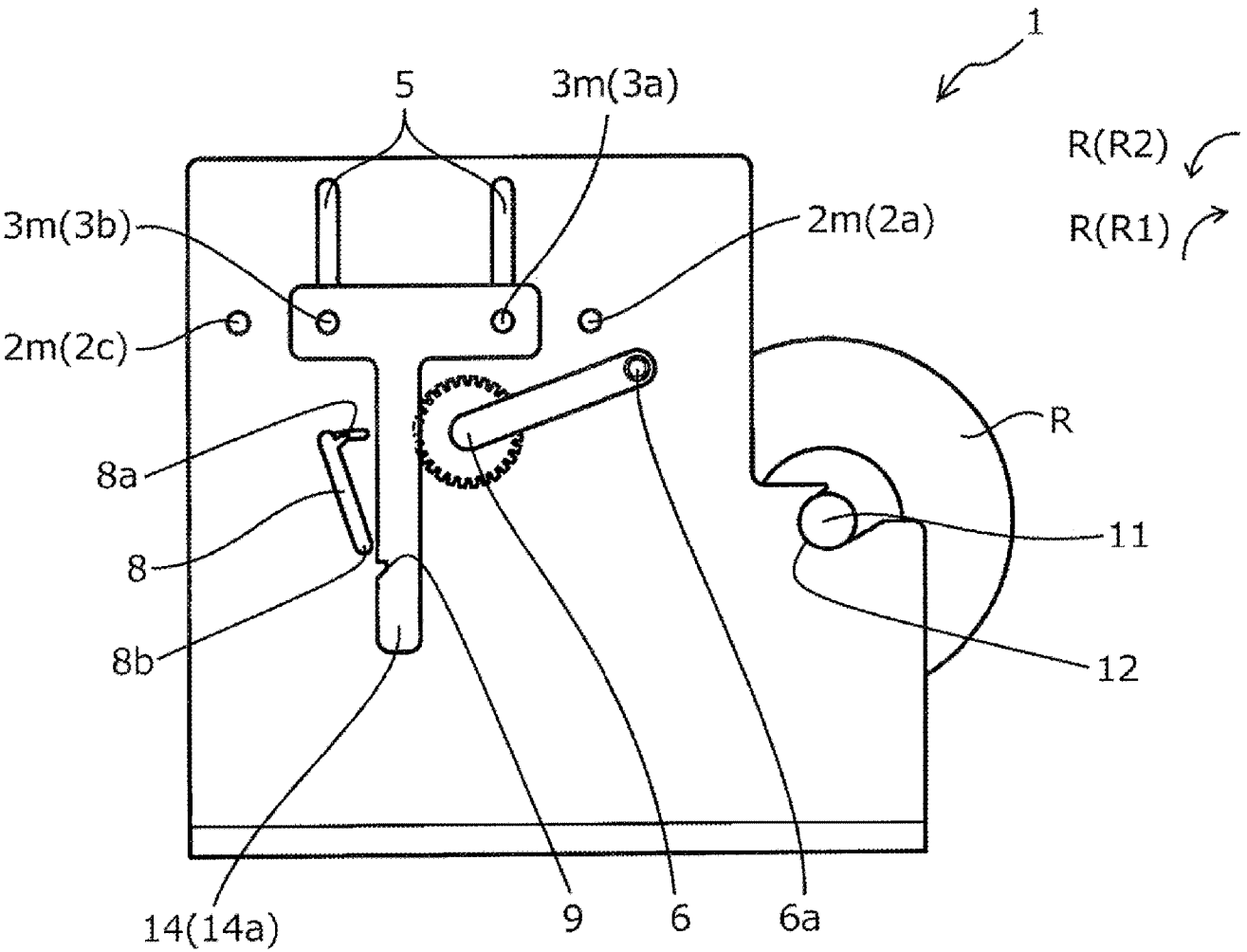
FIG. 5 is a schematic side view of the medium supply device according to Example 1 of the invention.
Figure 6:
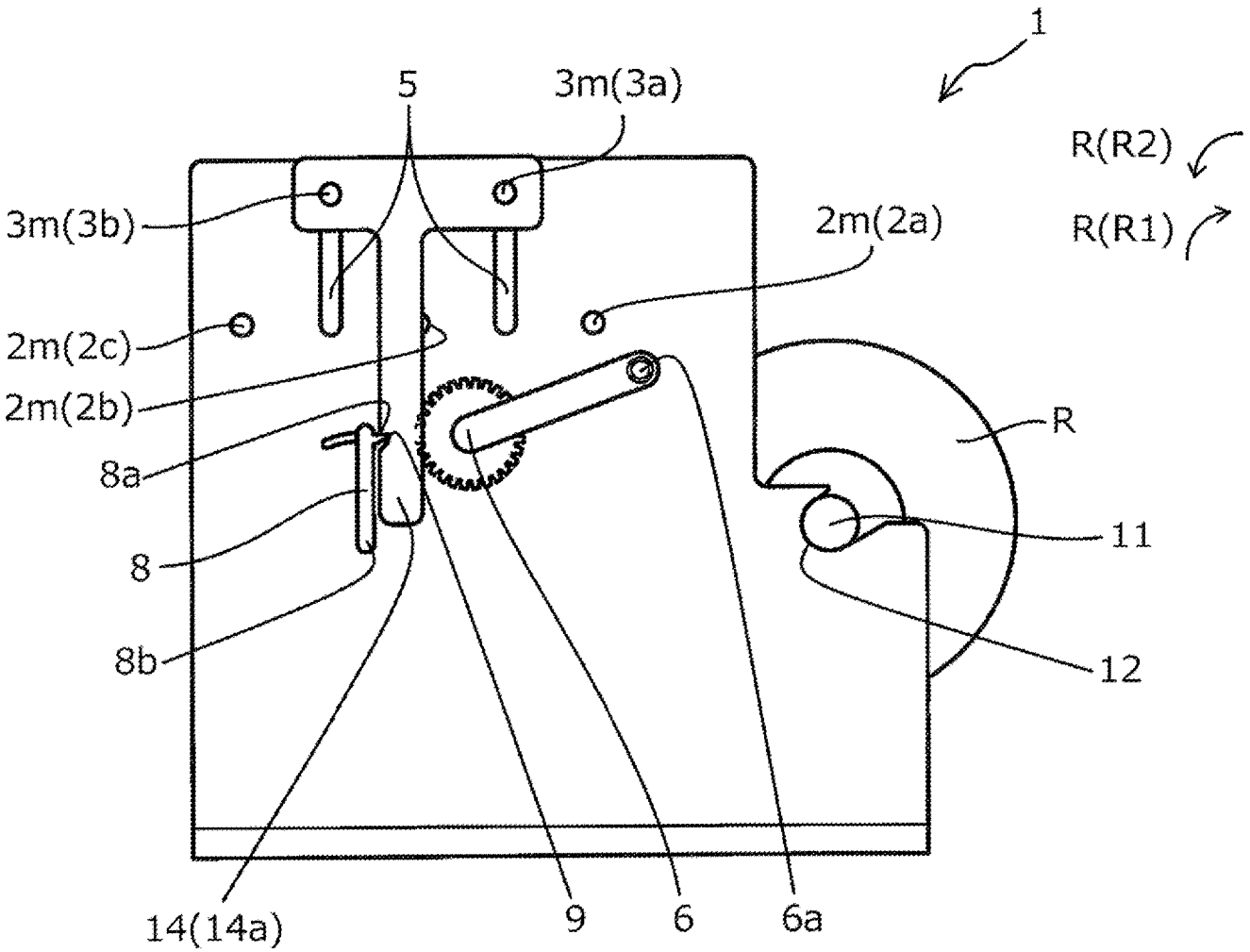
FIG. 6 is a schematic side view of the medium supply device according to Example 1 of the invention.
Figure 7:
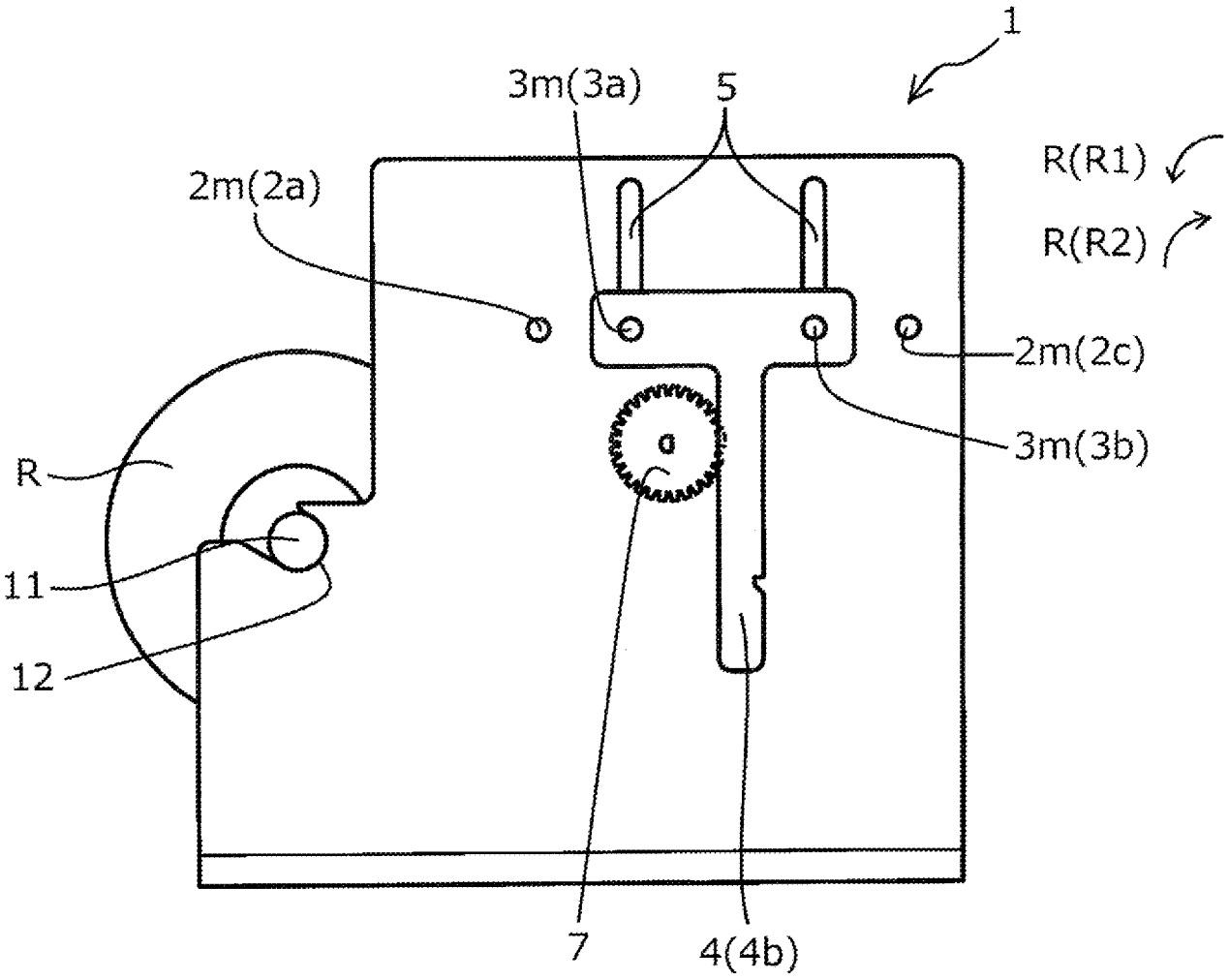
FIG. 7 is a schematic side view of the medium supply device according to Example 1 of the invention.
Figure 8:
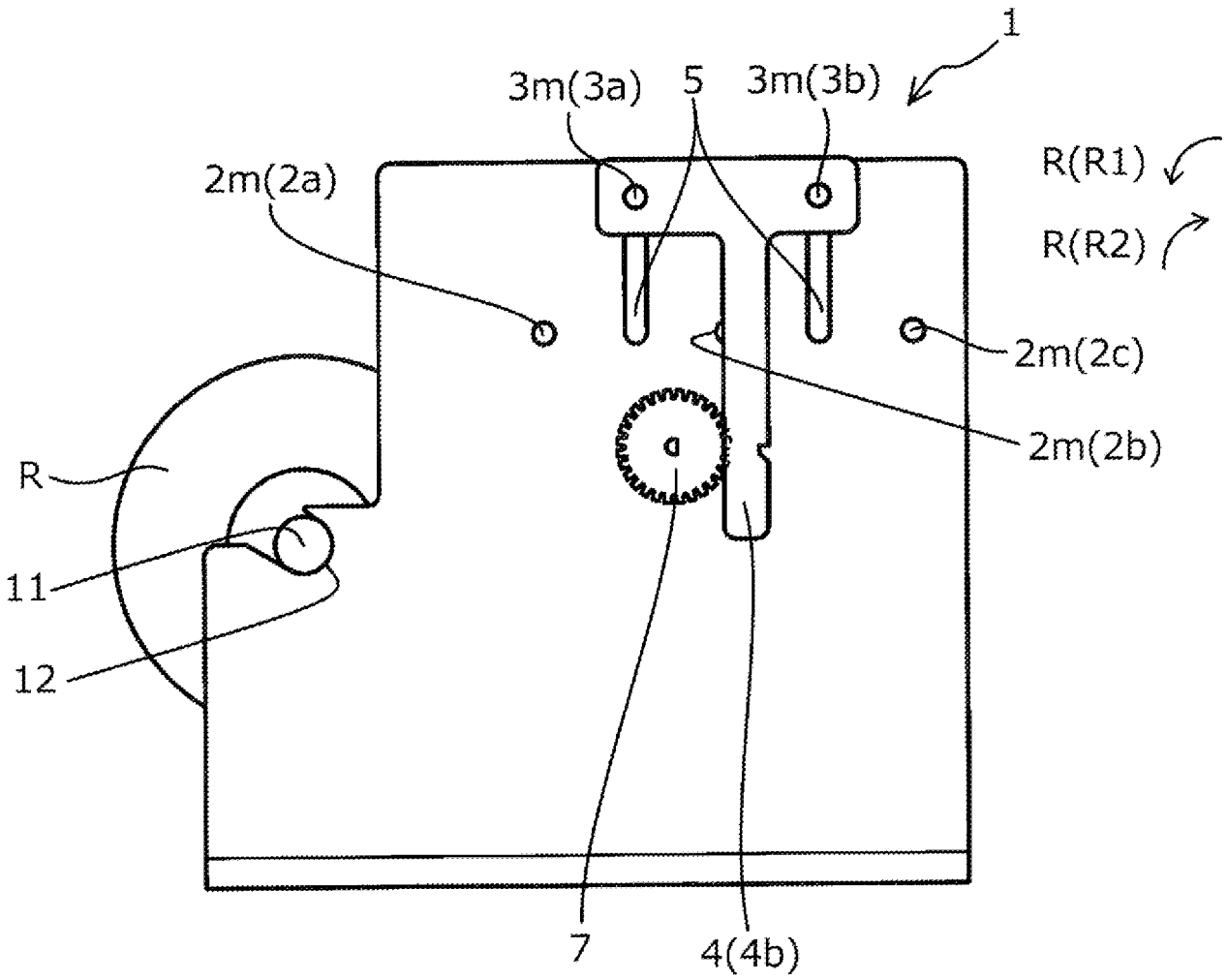
FIG. 8 is a schematic side view of the medium supply device according to Example 1 of the invention.

Further, FIGS. 5 to 8 are schematic side views of the medium supply device 1 according to this example. Of these, FIG. 5 is a side view from the side of the pinion portion 6 including the handle 6*a* of the moving mechanism 16 of the moving rollers 3, and illustrates the moving rollers 3 in a lowered state. Further, FIG. 6 is a side view from the side of the pinion portion 6 including the handle 6*a* of the moving mechanism 16 of the moving rollers 3, and illustrates the moving rollers 3 in a raised state. Further, FIG. 7 is a side view from the side of the pinion portion 7 of the moving mechanism 16 of the moving rollers 3, and illustrates the moving rollers 3 in a lowered state. Then, FIG. 8 is a side view from the side of the pinion portion 7 of the moving mechanism 16 of the moving rollers 3, and illustrates the moving rollers 3 in a raised state.

Figure 9:
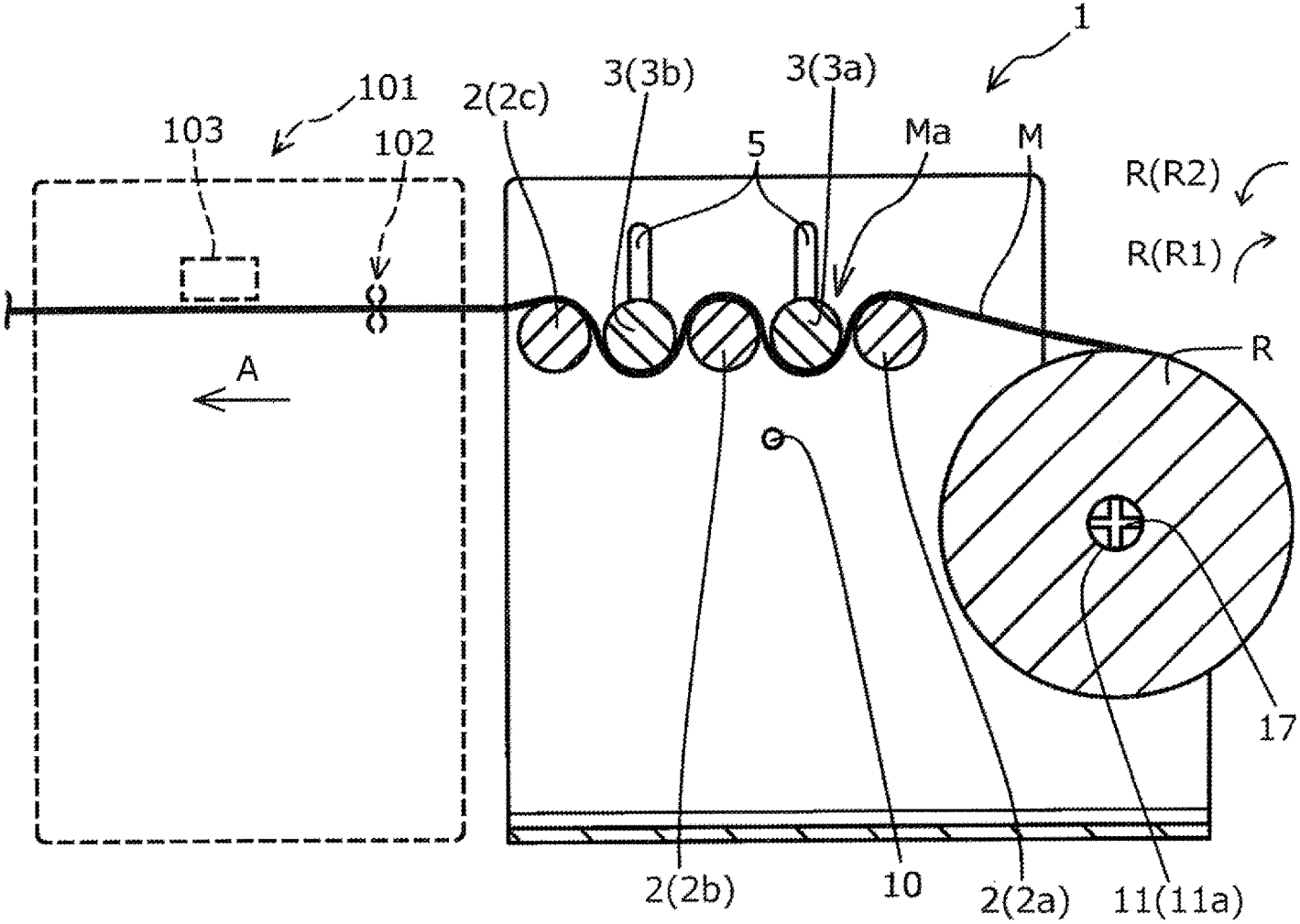
FIG. 9 is a schematic side cross-sectional view of the medium supply device according to Example 1 of the invention.
Figure 10:
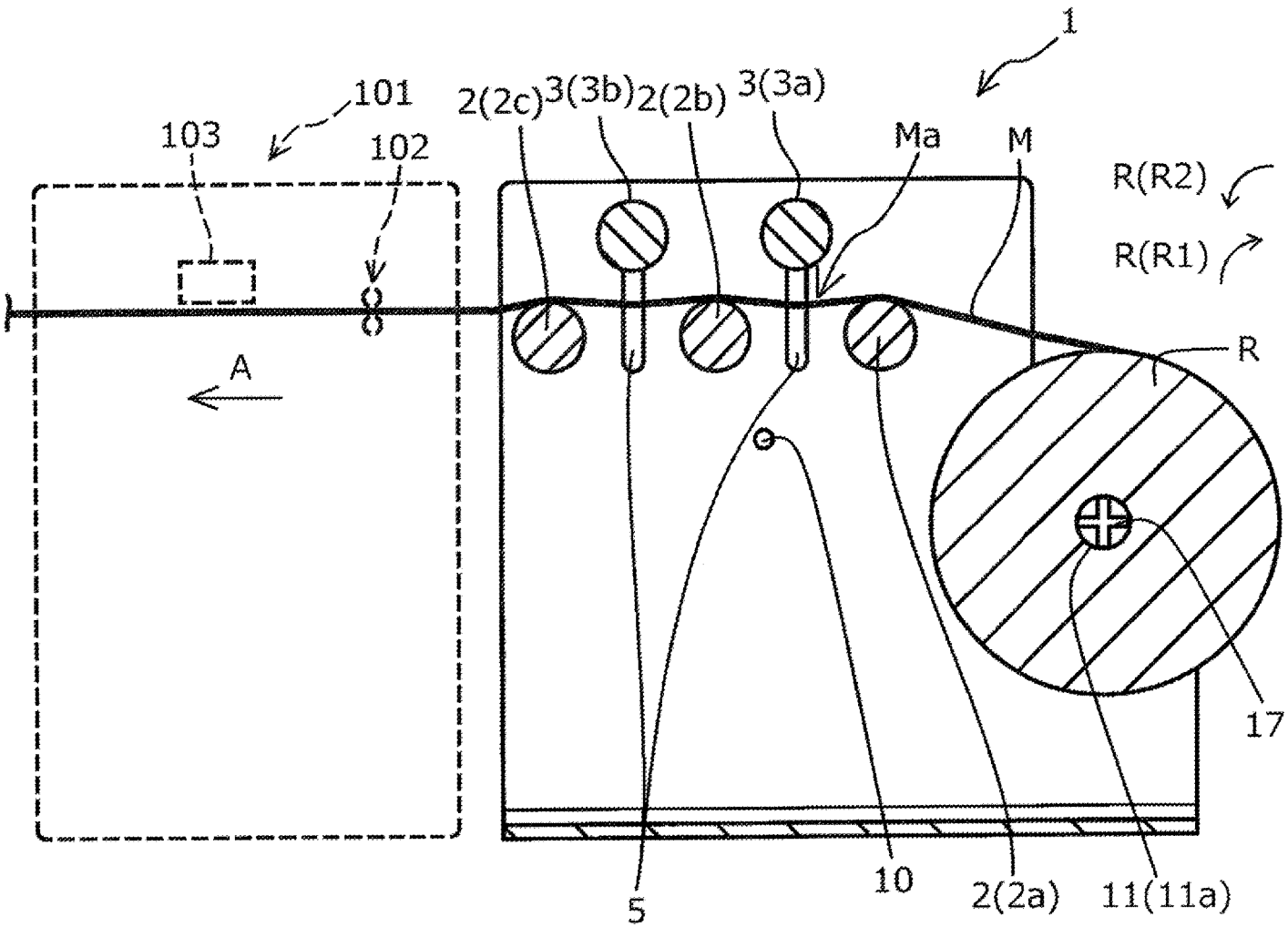
FIG. 10 is a schematic side cross-sectional view of the medium supply device according to Example 1 of the invention.

Further, FIGS. 9 and 10 are schematic side cross-sectional views of the medium supply device 1 according to this example. Of these, FIG. 9 is a side cross-sectional view illustrating the moving rollers 3 in a lowered state, and illustrates a medium M inserted and in a state allowing supply from a supplying portion 13 toward a recording device 101, which is an external device. Further, FIG. 10 is a side cross-sectional view illustrating the moving rollers 3 in a raised state, and illustrates when the medium M is inserted.

Here, FIGS. 1, 3, 5, 7, and 9 correspond to a state in which the moving rollers 3 are in a contact position of contact with the medium M when the medium M is inserted into the medium supply device 1. Then, FIGS. 2, 4, 6, 8, and 10 correspond to a state in which the moving rollers 3 are in a non-contact position of non-contact with the medium M, even when the medium M is inserted into the medium supply device 1.

Note that, in FIGS. 1 to 10, a portion of component elements are omitted for clarity of the configuration.

As illustrated in FIGS. 1 to 10, the medium supply device 1 of this example includes a spindle 11 that supports a roll R of the medium M. Then, as illustrated in FIGS. 1 to 8, the medium supply device 1 includes an insertion portion 12 configured to insert the spindle 11. Note that, as illustrated in FIGS. 9 and 10, to ensure that the spindle 11 does not flex even when the roll R of a large size is inserted, the spindle 11 of this example includes a shaft portion 11*a* made of a metal, and a reinforcing member 17 is provided to an interior of the shaft portion 11*a*. However, the configuration of the spindle 11 is not limited thereto.

Further, as illustrated in FIGS. 1 to 4 and the like, the medium supply device 1 of this example includes a plurality of support rollers 2 capable of supporting the medium M inserted into the medium supply device 1. Specifically, there are three support rollers 2, namely a support roller 2*a*, a support roller 2*b*, and a support roller 2*c* from an upstream side toward a downstream side in a transport direction A (refer to FIGS. 9 and 10) of the medium M. Note that a rotary shaft direction of each of the support rollers 2 is orthogonal to the transport direction A of the medium M. Then, the support roller 2*c* most downstream in the transport direction A also serves as the supplying portion 13 configured to supply the medium M toward an external device such as the recording device 101 (refer to FIGS. 9 and 10).

Note that the medium supply device 1 of this example is configured to allow the medium M to be supplied toward an external device such as the recording device 101, such as indicated by the dashed line in FIGS. 9 and 10, for example. The recording device 101 in this example includes a transport roller pair 102 as a transport portion configured to transport the medium M supplied form the medium supply device 1, and a recording head 103 configured to discharge ink onto the medium M supplied by the transport roller pair 102 to form an image. Nevertheless, the configuration of the recording device is not limited to such a configuration, and the external device is not limited to a recording device.

Further, as illustrated in FIGS. 1 to 4 and the like, the medium supply device 1 of this example includes the moving rollers 3 capable of moving in an up-down direction (in other words, a direction intersecting the transport direction A) by the moving mechanism 16. Specifically, there are two moving rollers 3, namely a moving roller 3*a* and a moving roller 3*b* from an upstream side toward a downstream side in the transport direction A of the medium M. Note that a rotary shaft direction of each of the moving rollers 2 is orthogonal to the transport direction A of the medium M, similar to the rotary shaft direction of the support roller 2. That is, the rotary shaft direction of all of the support rollers 2 and the moving rollers 3 are orthogonal to the transport direction A and parallel to one another.

Here, in the medium supply device 1 of this example, the spindle 11, the support rollers 2, and the moving rollers 3 are each a driven roller that rotates in association with movement of the medium M in the transport direction A. Thus, the medium supply device 1 of this example is a medium supply device based on the assumption that the medium M is transported (the medium M is supplied to an external device) by the transport portion (transport roller pair 102 of the recording device 101, for example) provided to an external device used on the downstream side of the supplying portion 13 of the medium M in the transport direction A. Nevertheless, naturally at least one of the spindle 11, the support rollers 2, and the moving rollers 3 may be configured to apply a transport force to the medium M to transport the medium M by a driving force of a motor or the like. Such a configuration is preferable to increase a supply performance of the medium M when the roll R having a large size is used, in particular.

Further, as described above, the medium supply device 1 of this example includes the moving mechanism 16 capable of moving the moving rollers 3 in the up-down direction. The moving mechanism 16, as illustrated in FIGS. 5, 6, and the like, includes the pinion portion 6 provided with the handle 6*a*, and a rack portion 4 (rack portion 4*a*) that engages with the pinion portion 6. Then, the moving mechanism 16, as illustrated in FIGS. 7, 8, and the like, includes a pinion portion 7 and the rack portion 4 (rack portion 4*b*) that engages with the pinion portion 7. Here, as illustrated in FIGS. 1 to 4 and the like, the rack portions 4 are each connected to the moving rollers 3 in a state in which shaft cores 3*m* of the moving rollers 3 extend through groove hole portions 5 extending in the up-down direction at both end portions of the moving roller 3. Then, the rack portion 4*a* and the rack portion 4*b* have the same shape in order to commonize the parts and thus reduce manufacturing costs.

Further, the pinion portion 6 and the pinion portion 7 are connected by a bar member 10 (refer to FIGS. 1, 3, and 4) and thus configured so that, with rotation of the pinion portion 6 in a rotational direction R1, the pinion portion 7 also rotates in the rotational direction R1 and, with rotation of the pinion portion 6 in a rotational direction R2, the pinion portion 7 also rotates in the rotational direction R2. Then, the configuration is such that, from the state illustrated in FIGS. 1, 3, 5, and 7, a user holds the handle 6*a* and rotates the pinion portion 6 in the rotational direction R1, causing the rack portions 4 to move upward along the groove hole portions 5 and, from the state illustrated in FIGS. 2, 4, 6, and 8, the user holds the handle 6*a* and rotates the pinion portion 6 in the rotational direction R2, causing the rack portions 4 to move downward along the groove hole portions 5. Then, in association with the movement of the rack portions in the up-down direction, the moving rollers 3 also move in the up-down direction.

Here, FIG. 9 illustrates a state in which the medium M is inserted into the medium supply device 1, allowing supply of the medium M from the supplying portion 13 toward an external device. As illustrated in FIG. 9, the medium M fed from the spindle 11 is brought into contact with (wound on) an upper circumferential surface of the support roller 2*a*, a lower circumferential surface of the moving roller 3*a*, an upper circumferential surface of the support roller 2*b*, a lower circumferential surface of the moving roller 3*b*, and an upper circumferential surface of the support roller 2*c*, and discharged (supplied) from the supplying portion 13 toward the external device. Thus, a contact surface area of the transported medium M and the support rollers 2 is greater, and the transportability of the medium is improved.

Note that, as illustrated in FIG. 9, the medium supply device 1 of this example is configured to support the medium M from a lower side by the support rollers 2 and apply a load from above by the moving rollers 3 between the support rollers 2. Nevertheless, the medium supply device 1 is not limited to such a configuration. For example, the medium M may be supported from an upper side by the support rollers 2 (the medium M may be pressed against the support rollers 2 positioned on the upper side), and a load may be supplied from a lower side by the moving rollers 3 between the support rollers 2. That is, the configuration is not limited to a support direction of the medium M by the support rollers 2 or a load direction of the load applied onto the medium M by the moving rollers 3.

Inserting the roll R of the medium M in a state in which the moving rollers 3 are lowered to a lower side (a state in which the moving rollers 3 are in a contact position allowing contact with the medium M) as illustrated in FIGS. 1, 3, 5, and 7 results in very poor operability for the user. This is because gaps between the support rollers 2 and the moving rollers 3 are small, and the medium M needs to be inserted while curved and moved in the transport direction A.

However, the medium supply device 1 of such an example as described above allows the moving rollers 3 to be raised to an upper side (a state in which the moving rollers 3 are in a non-contact position of non-contact with the medium M) as illustrated in FIGS. 2, 4, 6, 8, and 10. When the roll R of the medium M is thus inserted with the moving rollers 3 in a non-contact position, the gaps between the support rollers 2 and the moving rollers 3 in the up-down direction are widened, and the medium M can be inserted while being moved directly in the transport direction A. Then, when the moving rollers 3 are lowered to the contact position after the medium M is arranged in the state illustrated in FIG. 10 (in a state in which a bridging medium Ma extending across the support rollers 2 is formed in the medium M), the state can be simply made into one suitable for transport of the medium M (a state in which a winding length of the medium M on the support rollers 2 is long), which is the state illustrated in FIG. 9 (a state in which a load is applied to the bridging medium Ma between the support rollers 2). Thus, the medium supply device 1 of this example can transport the medium M with high precision, and can reduce the load when the medium M is inserted. Note that the winding length of the medium M on the support roller 2 refers to a contact length of the medium M in the transport direction A on the circumferential surface of the support roller 2.

Here, in summary, the medium supply device 1 of this example includes the spindle 11 configured to support the roll R of the medium M (the medium M having a roll shape), the supplying portion 13 configured to supply the medium M supported by the spindle 11 toward the outside, and the plurality of support rollers 2 configured to support the medium M in positions between the spindle 11 and the supplying portion 3. Furthermore, the medium supply device 1 further includes the moving rollers 3 that, in the contact position between the support rollers 2, are capable of contacting (refer to FIG. 9) the bridging medium Ma in a state in which a load is applied to the bridging medium Ma (refer to FIG. 10), the bridging medium Ma being the medium M extending across the support rollers 2, and capable of moving from the contact position to the non-contact position (refer to FIG. 10) of non-contact with the bridging medium M, and the moving mechanism 16 that moves the moving rollers 2 from the contact position to the non-contact position.

The medium supply device 1 of this example includes the moving rollers 3 and the moving mechanism 16 having such a configuration, making it possible to increase the contact surface area between the transported medium M and the support rollers 2 (making it possible to lengthen the winding length of the medium M on the support rollers 2; refer to FIG. 9) by positioning the moving rollers 3 into the contact position by the moving mechanism 16, and thus improve the transportability of the medium M. Then, the moving rollers 3 are temporarily positioned in the non-contact position by the moving mechanism 16 (refer to FIG. 10), allowing the medium M to be directly fed and inserted and making it possible to improve the operability when the medium M is inserted.

Further, as described above, the medium supply device 1 of this example includes the moving mechanism 16, and the moving mechanism 16 includes the rack portion 4*a* connected to the moving rollers 3, and the pinion portion 6 engaged with the rack portion 4*a* and provided with the handle 6*a*. The medium supply device 1 of this example, having such a simple configuration, allows the moving rollers 3 to be easily moved between the contact position and the non-contact position.

Note that, as described above, the moving mechanism 16 of this example further includes the rack portion 4*b* connected to the moving rollers 3, and the pinion portion 7 engaged with the rack portion 4*b* and connected to the pinion portion 6 via the bar member 10, causing the pinion portion 7 to rotate in association with the rotation of the pinion portion 6. As a result, the moving rollers 3 can be particularly effectively moved between the contact position and the non-contact position. However, the moving mechanism 16 is not limited to such a configuration, and may be configured to not include the rack portion 4*b* and the pinion portion 7, for example.

Here, the moving mechanism 16 of this example further includes a fixing mechanism 8 configured to fix the position of the pinion portion 6 as illustrated in FIGS. 5, 6, and the like. Specifically, the fixing mechanism 8 includes a pivoting shaft 8*b* formed on one end side of the fixing mechanism 8 and pivotably fixed to a housing section, and a protruding portion 8*a* formed on the other end side of the fixing mechanism 8. The fixing mechanism is thus configured to be pivotable in the rotational direction R1 and the rotational direction R2 with the pivotable shaft 8*b* as a reference. Then, as illustrated in FIG. 5 and the like, a recessed portion 9 is formed on the rack portion 4*a* and, as illustrated in FIG. 6, when the rack portion 4*a* is in a predetermined position (that is, when the moving rollers 3 are in the predetermined non-contact position), the protrusion portion 8*a* can be inserted into the recessed portion 9 to fix the rack portion 4*a*.

Note that, while not provided to the moving mechanism 16 in this example, a recessed portion that allows the protrusion portion 8*a* to be inserted when the moving rollers 3 (rack portion 4*a*) are in a predetermined contact position such as illustrated in FIG. 5 may be further provided. With such a configuration, even when the moving rollers 3 are in the predetermined contact position, the protrusion portion 8*a* can be inserted into the recessed portion to fix the rack portion 4*a*.

Thus, preferably the fixing mechanism 8 configured to fix the moving rollers 3 in at least one of the contact position and the non-contact position is provided. This is because, with such a configuration, the moving rollers 3 can be fixed in at least one of the contact position and the non-contact position, making it possible to suppress unintended movement by the moving rollers positioned in the contact position or the non-contact position.

Further, as illustrated in FIG. 9, the contact position of the medium supply device 1 of this example is a position in which the shaft cores 3*m* of the moving rollers 3 reach a shaft core plane F connecting the shaft cores 2*m* of the support rollers 2 from the non-contact position.

Thus, preferably the contact position is a position in which the moving rollers 3 are moved from the non-contact position to a position where the shaft cores 3*m* of the moving rollers 3 reach the shaft core surface F connecting the shaft cores 2*m* of the support rollers 2. This is because, with such a configuration, the contact surface area between the medium M and the support rollers 2 can be effectively increased, and the transportability of the medium M can be effectively improved.

Next, the medium supply device 1 according to example 2 will be described.

Figure 11:
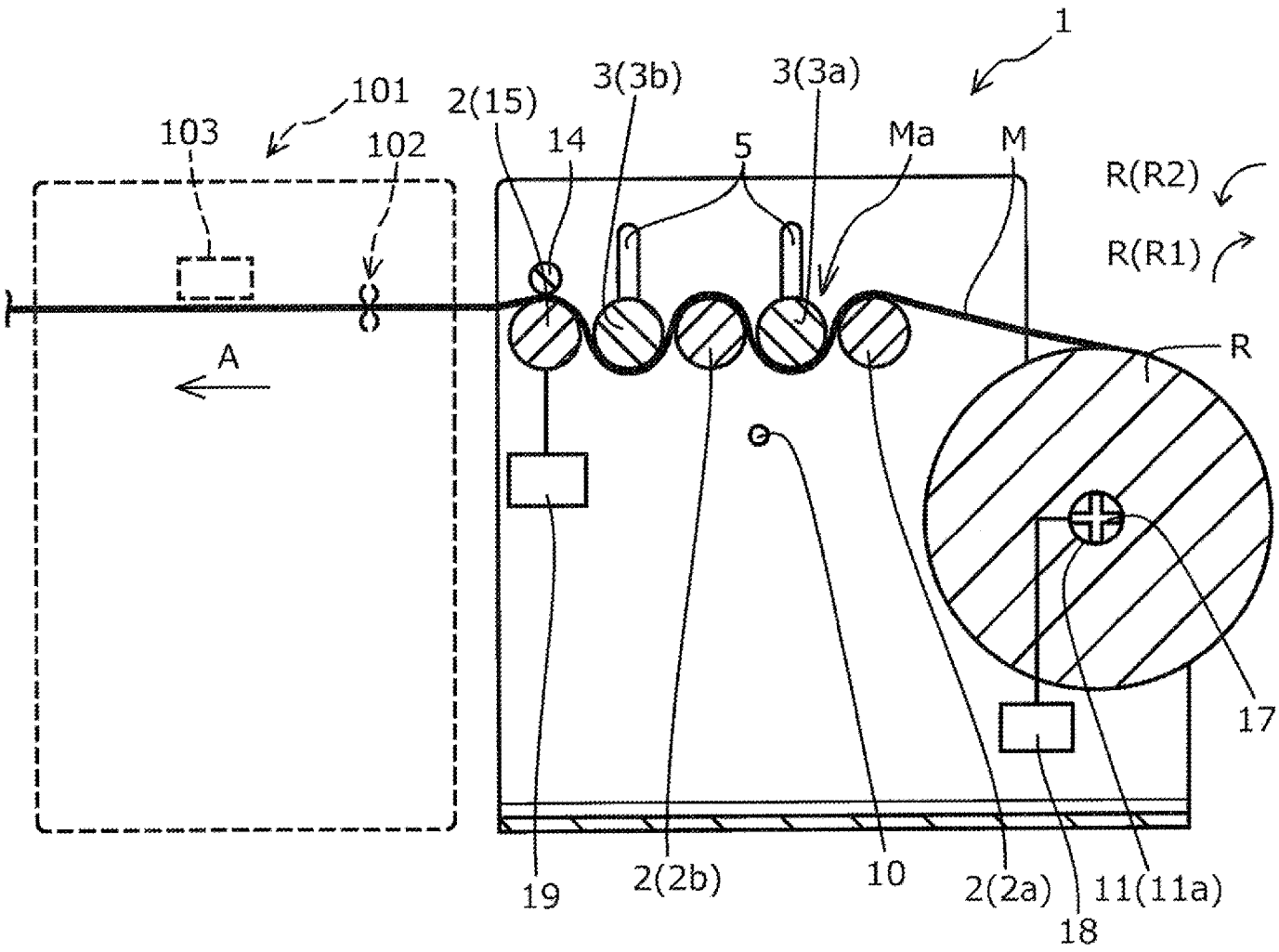
FIG. 11 is a schematic side cross-sectional view of the medium supply device according to Example 2 of the invention.

Example 2 (FIG. 11)

FIG. 11 is a schematic side cross-sectional view of the medium supply device 1 of this example, and is a figure corresponding to FIG. 9 of the medium supply device 1 of Example 1. Like numbers designate identical or corresponding component elements in Example 1, described above, and detailed description for such component elements are omitted.

As illustrated in FIG. 11, in the medium supply device 1 of this example, the support roller 2 corresponding to the support roller 2*c* on the most downstream side of the medium supply device 1 of Example 1 in the transport direction A is connected with a motor 19 and serves as a transport roller 15 that rotates by a driving force of the motor 19 and applies to the medium M a transport force for transporting the medium M.

Thus, the medium M can be effectively supplied from the supplying portion 13 by making at least one of the support rollers 2 serve as the transport roller 15 configured to apply to the medium M a transport force for transporting the medium M. Thus, even when, for example, the roll R of the medium M of a large size is used and the transport mechanism of the external device (transport roller pair 102 of the recording device 101, for example) configured to supply the medium M from the medium supply device 1 has a weak medium transport force, the medium supply device 1 of this example can effectively supply the medium M to the external device.

Further, as illustrated in FIG. 11, the medium supply device 1 of this example further includes a press roller 14 configured to press the medium M against the transport roller 15. Thus, the medium supply device 1 of this example can more effectively transport the medium M by the roller pair of the transport roller 15 and the press roller 14, and particularly effectively supply the medium M to the external device.

Further, as illustrated in FIG. 11, in the medium supply device 1 of this example, the spindle 11 is connected with a motor 18 and configured allow the medium M to be fed upon rotation by a driving force of the motor 18. That is, the medium supply device 1 of this example includes the motor 18 configured to rotate the spindle 11, making it possible to effectively supply the medium M from the supplying portion 13 to the external device. Thus, the medium supply device 1 of this example can effectively supply the medium M even when, for example, the roll R of the medium M of a large size is used and the transport mechanism of the external device configured to supply the medium M from the medium supply device 1 has a weak medium transport force.

Note that the invention is not intended to be limited to the aforementioned examples, and many variations are possible within the scope of the invention as described in the appended claims. It goes without saying that such variations also fall within the scope of the invention.

This application claims priority under 35 U.S.C. § 119 to Japanese Patent Application No. 2018-016536, filed Feb. 1, 2018. The entire disclosure of Japanese Patent Application No. 2018-016536 is hereby incorporated herein by reference.

What is claimed is:

1. A medium supply device comprising:

a spindle configured to support a medium having a roll shape;

a supplying portion configured to supply the medium supported by the spindle toward outside;

a plurality of support rollers configured to support the medium in positions between the spindle and the supplying portion;

a moving roller that, in a contact position between the plurality of support rollers, is capable of coming into contact with a bridging medium, which is the medium extending across the plurality of support rollers, in a state where a load is applied to the bridging medium, the moving roller being capable of moving from the contact position to a non-contact position of non-contact with the bridging medium; and a moving mechanism configured to move the moving roller from the contact position to the non-contact position, wherein at least one of the plurality of support rollers is a transport roller configured to apply to the medium a transport force for transporting the medium, and wherein the moving mechanism includes a rack portion connected to the moving roller, and a pinion portion provided with a handle.

2. The medium supply device according to claim 1, wherein the contact position is a position where the moving roller is moved from the non-contact position to a position where a shaft core of the moving roller reaches or passes a shaft core plane connecting respective shaft cores of the plurality of support rollers.

3. The medium supply device according to claim 1, comprising a press roller configured to press the medium against the transport roller.

4. The medium supply device according to claim 1, comprising a motor configured to rotate the spindle.

5. The medium supply device according to claim 1, comprising a fixing mechanism configured to fix the moving roller in at least one of the contact position and the non-contact position.

6. The medium supply device according to claim 1, wherein the transport roller is the support roller among the plurality of support rollers that is located most downstream in a transport direction of the medium.

* * * * *